United States Patent [19]

Jörss

[11] Patent Number: 4,469,548

[45] Date of Patent: Sep. 4, 1984

[54] LABELLING STATION OF A LABELLING MACHINE

[75] Inventor: Norbert Jörss, Neutraubling, Fed. Rep. of Germany

[73] Assignee: Pirzer Co., Neutraubling, Fed. Rep. of Germany

[21] Appl. No.: 446,664

[22] Filed: Dec. 3, 1982

[30] Foreign Application Priority Data

Dec. 17, 1981 [DE] Fed. Rep. of Germany ..... 3150089

[51] Int. Cl.[3] ..... B65C 9/02; B65C 9/16

[52] U.S. Cl. ..... 156/567; 156/568; 156/571; 156/DIG. 25; 156/DIG. 32

[58] Field of Search ..... 156/567, 568, 571, 578, 156/DIG. 25, DIG. 32

[56] References Cited

U.S. PATENT DOCUMENTS

| | | | |
|---|---|---|---|
| 3,528,871 | 9/1970 | Munch | 156/571 |
| 4,280,866 | 7/1981 | Zodrow et al. | 156/568 |
| 4,362,594 | 12/1982 | Nagano et al. | 156/567 |

*Primary Examiner*—Michael G. Wityshyn
*Attorney, Agent, or Firm*—Fred Wiviott

[57] ABSTRACT

A labelling station of a labelling machine has a label transfer assembly which is rotatably mounted about a first axis for receiving labels from a label supply station and transferring the same to a label gripper cylinder rotatably mounted about a second axis parallel to the first. The drive for the labelling station is operated in synchronism with the main drive of the labelling machine and includes a planetary gear which is rotatably mounted about the first axis and a first gear mounted on the planetary gear for rotation about a third axis parallel to the first axis. In addition, there are second and third gears which mesh with the first gear and rotate about the first axis. First adjustment means is coupled to the third gear for changing the angular orientation of the label transfer assembly relative to the planetary gear and second adjustment means is operable for moving the transfer assembly and gripper cylinder toward and away from the labelling machine to accommodate different sized containers.

12 Claims, 3 Drawing Figures

LABELLING STATION OF A LABELLING MACHINE

Figure 1:
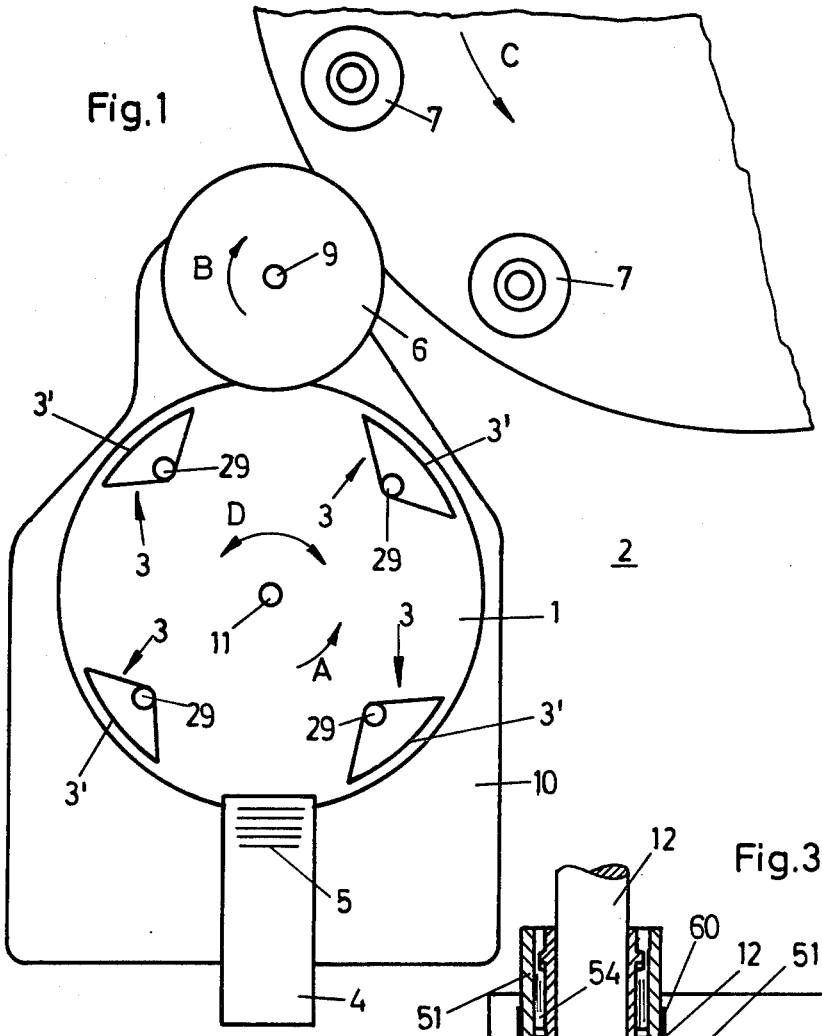

The invention relates to a labeling station of a labeling machine for containers, especially bottles, with at least one transfer element (label pallet) which rotates around a first axle on a machine base and with at least one label supply station, from which the labels are transferred to at least one on a second axle rotating driven element e.g. a cylinder of a labeling station by means of the label tranfer element, whereby the element of the labeling station rotates synchronously with the label transfer element and whereby the label transfer element can be coupled via a drive with the drive means of the labeling machine for a synchronous drive system, and whereby for the purpose of labeling containers with different diameters the angle setting of a driving part of this drive system, which is coupled with the label transfer element, can be changed vis a vis a driven part of the drive system, which can be coupled with the drive means of the labeling machine.

Labeling stations or labeling mechanisms are known, whereby the labels are transferred to a rotating element (e.g. gripper cylinder) which rotates synchronously with the label transfer element, by means of e.g. a label transfer element (label pallet) which rotates around a vertical axle and takes the labels from a label supply station.

It is in principle known, to design such labeling stations so, that one and the same labeling station or one and the same labeling machine with such a station can be used to label containers, especially bottles.

Since it is required for the transfer of the labels from the labeling station, or from the gripper cylinder that is located there, to the containers or bottles that move past this labeling station, that the gripper cylinder touches with its peripheral surface the path of travel of the passing bottles, the position of the gripper cylinder must be set in correspondence with the appropriate diameter of the bottles, i.e. with a labeling machine with a rotary bottle or container table rotating around a vertical axle, and with a labeling station that is located at the peripheral or exterior side of this rotary table, the vertical rotary axle of the gripper cylinder must show a smaller distance from the rotary axle of the rotary table in the case of a small bottle or container diameter than in the case of containers or bottles with a larger diameter.

This setting of the gripper cylinder in dependence on the container or bottle diameter is without problems in so far, when the gripper cylinder and also the label transfer element must rotate each time synchronously with the bottles that pass the labeling station, i.e. e.g. synchronously with the rotary table of the labeling machine and when, besides this, a proper transfer of the labels to the containers or bottles is only then secured, when each angle setting of the rotary table has a very specific angle setting of the gripper cylinder or of the label transfer component.

This requirement of an absolutely synchronous rotating of rotary table and label transfer element or gripper cylinder (dependent on the position setting of the gripper cylinder) has led to very expensive constructions in the cases of known labeling stations or labeling machines with which containers of different dimensions can be labeled.

With a per se constructually simple labeling station or labeling machine, the adaption to different container or bottle diameters is achieved thereby, that firstly the gripper cylinder is mounted to an intermediate carrier so that it can rotate, which can be swiveled around a vertical axle, which coincides with the first axle around which the label transfer element rotates. Also with this kind of labeling station which is per se simple in construction and works reliably it can not be avoided that with the swiveling of the intermediate carrier an angle or phase shifting occurs between the gripper cylinder and the drive means of the labeling machine. To compensate or correct this angle shifting the known labeling machines have a drive that has one common shaft each time with a helical gear system which in turn meshes or is in contact with gears that are also helical. By moving this common shaft longitudinally, the aforementioned correction setting is achieved in the case of the known labeling station.

However, with the known labeling station, the required helical gearing for this correction setting has as a result, that at least four helical gears must be made which increases the cost of the entire mechanism considerably. If it is required that, on the basis of construction or price, all gears which serve as drive coupling of the different components of a labeling station, must be arranged on one level, then it is required that all gears must be helical in the case of the known labeling station.

It is the task of the invention to design a labeling station as described initially, whereby the correction setting is achieved by simple means, and above all without the necessity of utilizing expensive helical gears.

To complete this task a labeling station as initially described is—in keeping with the invention—executed so, that the drive system is a planetary gear drive system which has at least one first carrier which can rotate around a third axle, on which carrier a first gear is mounted around a fourth axle parallel to the third axle, and secondly that the first gear meshes with a second as well as a third gear, which are attached in each case to a second respectively third carrier, (e.g. a shaft) which carriers rotate around the third axle and thirdly that one carrier forms the driven part and another carrier forms the driving part of the drive system, while one carrier is fixed to the third axle, however adjustable.

With a preferred configuration of the invention related labeling station the first carrier to the planetary gear carrier, that carries the first gear forms the driven part of the drive system, i.e. this carrier is, as pertaining to drive, connected with the drive means of the labeling machine via a gear system. For this purpose the first carrier meshes with its gearing e.g. with a gearing which is located at the rotary table of a labeling machine or which is formed by a gear that is connected with the rotary table.

In this configuration the driving part of the drive system is formed by e.g. the second gear or the shaft that is connected with this second gear while the third gear or a shaft connected with this third gear carries an adjustment component e.g. a lever arm, with which the third gear or its shaft is held torsionally fixed, whereby however a turning or swiveling of the third gear around the axle of the planetary gear drive (third axle) is possible.

The invention related labeling station excels through a specially simple and inexpensive construction because of the lack of necessity for helical gears. With the invention related labeling station the correction setting can be carried out continuously over a wide range, and above all while the labeling station or labeling machine is operating so that it is also possible to test the operation or result of the executed corrected setting visually on the bottles, which leave the labeling station or labeling machine.

Further configurations of the invention are the subject of secondary claims.

The invention is hereafter more closely explained on the hand of the figures giving an example of the configuration. They are:

FIG. 1 A labeling station in top view and depicted in diagram, together with a part of the rotary table of a labeling machine.

Figure 2:
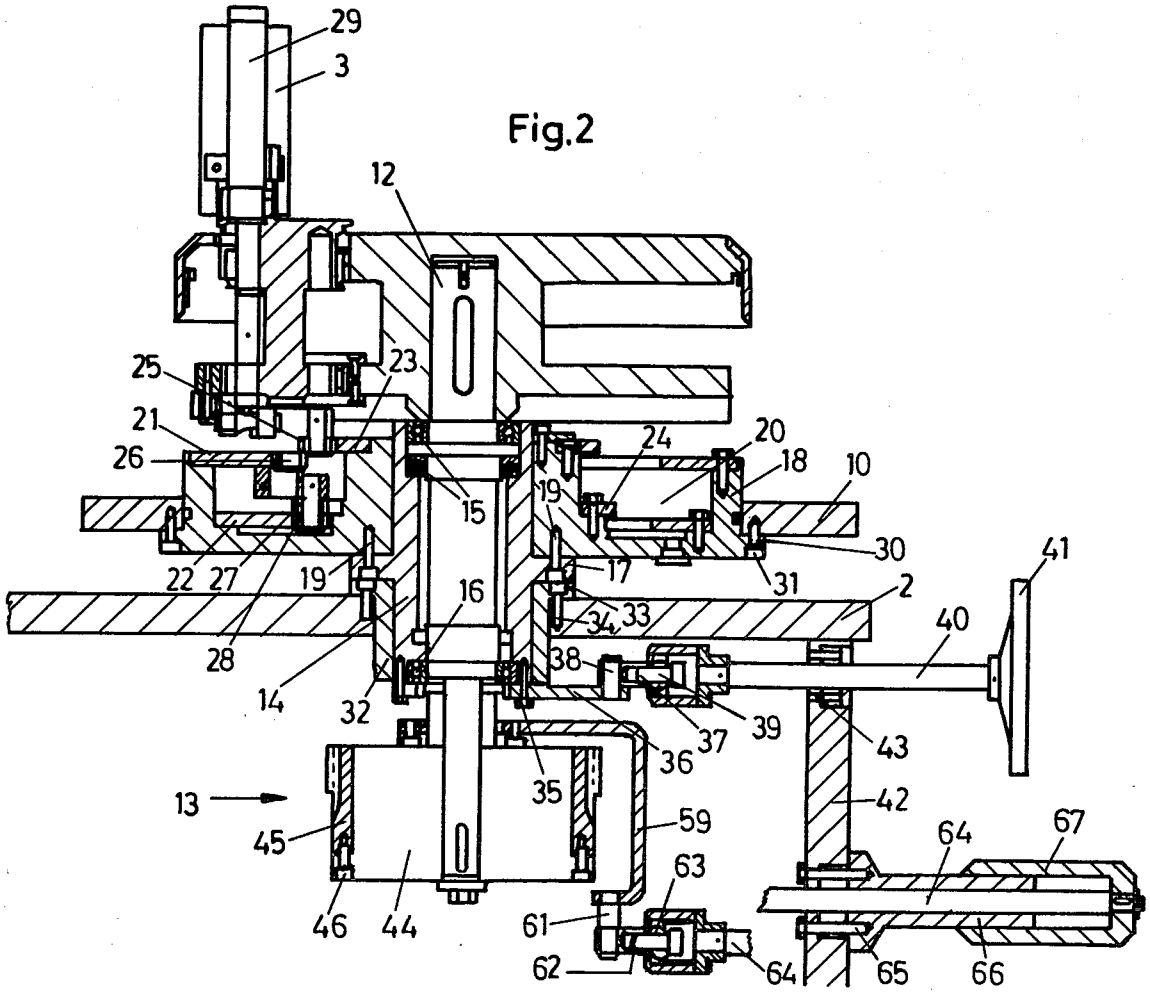

FIG. 2 The drive as well as the mounting of the label transfer component together with the drive system for the correction setting to be used with the labeling station as in FIG. 1.

Figure 3:
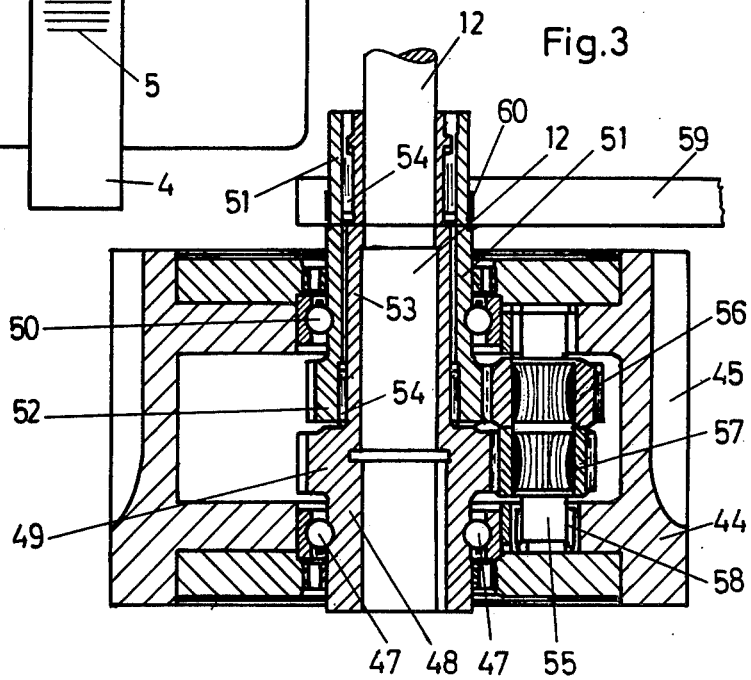

FIG. 3 The drive system for the correction setting to be used with the labeling station as per FIG. 1 in cross section to enlarged scale.

The labeling station depicted in the figures consists essentially of:

a. a carrier plate 1, which is mounted so that it can rotate around a vertical axle on a machine base or on a horizontal machine table 2 which is formed by this machine base, b. several label transfer components or label pallets 3 which are mounted on the carrier plate 1 so that they each can pivot around a vertical axle. These label pallets 3 have a curved or partially cylindrical surface 3' to pick up and hold labels.

c. a label supply station mounted on the machine table 2 with a number of labels 5 in the form of a stack of labels ready for the labeling process from which label stack one label lies in the path of travel of the label pallets 3 and at that end that serves for the purpose of label release 5, d. a gripper cylinder 6 which can also rotate around a vertical axle and forms the labeling site of the labeling station. The gripper cylinder 6 is, as pertaining to the drive, connected with the carrier plate 1 so, that this gripper cylinder rotates synchronously with the carrier plate 1, whereby the gripper cylinder 6 with its peripheral or outside surface touches also the path of travel of the label pallets 3.

The principle for the depiction chosen for FIG. 1 is, that the carrier plate 1 rotates counter clock wise around the vertical axis, i.e. in the direction of the arrow A, while the gripper cylinder 6 is, as to drive, connected with the carrier plate 1 so, that the gripper cylinder 6 rotates clockwise, i.e. in the direction of the arrow B.

At the carrier plate 1 a not more closely detailed glue mechanism is mounted ahead of the label supply station, i.e. the label pallets 3 have a film of glue on their surfaces 3' because of the glue mechanism, which film of glue is applied before the label pallets pass the label supply station 4.

Furthermore the gripper cylinder 6 is located with its peripheral surface in the path of travel of the bottles 7, which are in upright position on the not more closely detailed rotary plates of a rotary table 8 of the labeling machine and which are moved past the gripper cylinder 6, by means of the rotary table 8 which rotates around a vertical axle in the direction of the arrow C. The bottles 7 are thereby, e.g. in conventional fashion held in place between overhead holding devices of the labeling machine and the rotary plates of the rotary table 8 to prevent falling over.

As per se known with labeling stations the application of a label 5 to a bottle 7 takes place in such a way that this label 5 is taken from the label supply station 4 by a glue covered label pallet 3 and that the label 5, now covered with glue at the back, is transferred to the gripper cylinder 6, which applies the label 5 in question to a bottle 7 which stands ready for this. The final smoothing or pressing on of this label 5 to this bottle 7 takes place in an equally well known way by pressing on components, which are mounted in the labeling machine subsequent to the labeling station.

If bottles 7 with different diameters must be labeled with one and the same labeling station or labeling machine, it is then required to design the labeling station so, that the gripper cylinder 6 can be set relative to or perpendicular to the path of travel of the bottles 7 on the rotary table 8, i.e. with bottles 7 with a larger diameter, the vertical rotary axle 9 of the gripper cylinder 6 must show a greater distance from the vertical rotary axle of the rotary table than with bottles 7 with a smaller diameter. This is achieved thereby, that the gripper cylinder 6, connected solidly with the carrier plate 1 as regards drive via one or more gears, is mounted on an intermediate carrier 10, so that it can rotate and that this gripper cylinder 6 can be rotated or swiveled in the direction of the double arrow D around the vertical rotary axle 11 of the carrier plate 1 so, that by swiveling this intermediate carrier 10 a setting for the position of the gripper cylinder 6 is possible which corresponds with each diameter 7. In this case the label supply station is then preferably also mounted on the intermediate carrier 10.

In order that a flawless transfer of the labels 5 to the bottle 7 is warranted, it is not only required that the gripper cylinder 6 rotates synchronously with the carrier plate 1, but this carrier plate 1 or the driving shaft 12 of the carrier plate 1, the axle of which forms the rotary axle 11, must rotate synchronously with the rotary table 1, i.e. the axle 12 is connected via a drive 13 directly to the rotary table 8 or with a drive of the labeling machine which drives this rotary table, and this by means of one or more meshing gears.

In as far as no special means are provided, the angle setting changes with each setting of the intermediate carrier 10 around the rotary axle 11. This angle setting is shown by the gripper cylinder 6 or the carrier plate 1 in relation to a certain setting of the rotary table 8 or the drive for this rotary table. This would lead to the proper application of the labels 5 to the bottles 7 only in a very specific area of the intermediate carrier 10, i.e. preferably applied to the bottles 7 so, that the labels 5 are each time first lying against the bottle 7 with their central area, while with different settings of the intermediate carrier 10 a proper application of the labels 5 to the bottles 7 can no longer by warranted. In these settings of the intermediate carrier 10 the labels 5 would then be transferred to the bottles 7 e.g. off-center, i.e. especially labels 5, which must be applied to a conical bottle neck, are lying on an angle to the longitudinal bottle axis. In the case of extreme settings of the intermediate carrier 10, as required for the adaptation to bottles with very different diameters, it can even happen, that the labels 5 can actually no longer be transferred by the gripper cylinder 6 to the bottles 7 or that the gripper cylinder grippers which are to hold the labels 5 hit against the bottles 7.

To avoid these disadvantages, the drive 13 is designed so, that with it a correction setting can be incorporated, i.e. the angle rotation or phase shifting of the carrier plate 1 and of the gripper cylinder 6, which takes place with the setting of the intermediate carrier 10 around the vertical axle 11, can again be compensated by the drive 13, as will hereafter be explained in greater detail on the hand of FIG. 2 and 3. As FIG. 2 shows, the shaft 12 of the carrier plate 1 is mounted so that it can rotate in a sleeve shaped bearing component 14 which surrounds this shaft by means of ball bearings 15 and 16, whereby the carrier plate 1 is attached to the upper end of the shaft 12 which stands above the bearing component 14. The bearing component 14 has, in about the middle of it, a ring shaped flange 17 which stands above the outer surface of this sleeve shaped bearing component, on which flange a plate shaped component 18 is positioned. This plate shaped component 18 is torsionally solidly connected with the bearing component 15 by means of screws 19 which go through the holes of the flange 17. At its upper side, i.e. at the side that faces the carrier plate 1, the plate shaped component 18, which is mounted under the carrier plate 1, has a ring-shaped channel 20 which surrounds the shaft 12 and in which several disc shaped components 21 through 24, which are attached to the component 18, form control cams. These control cams work together with corresponding rollers 25–28 on the carrier plate 1 and serve to rotate or swivel the individual label pallets 3 around there vertical axle on the carrier plate 1 by means of the aforementioned rollers as well as not more closely detailed levers. Each label pallet 3 at its upper end is then connected to a vertical shaft 29 in the carrier plate 1 so that it can rotate or swivel as the carrier plate 1 rotates. This shaft is rotated or swiveled by means of the control cams which are formed by the disc shaped components 21 through 24, or by means of the rollers 25 through 28 via the appropriate not more closely detailed levers.

The intermediate carrier 10 is connected to the plate shaped component 18. For this purpose, the plate shaped element 18 has in the area of its lower side a protruding flange 30 which has holes for screws 31 which go through this flange and into the threads of the intermediate carrier 10.

The sleeve shaped bearing component 14 is mounted in a sleeve shaped component 32, which sits in a hole of the machine table 2 and has at its upper end a laterally protruding flange 33 as shown in FIG. 2. At this flange 33 the sleeve shaped component 32 is attached to the machine table 2 by means of screws 34. The upper side of the flange 33 serves as positioning surface for the flange 17 of the bearing component 14, which together with the plate shaped component 18 and the intermediate carrier 10 can be rotated or swiveled in the sleeve shaped component 32 around the rotary axle 11 which is formed by the shaft 12.

For this purpose a laterally off-set lever arm 36 is attached to the lower end by means of screws 35 as shown in FIG. 2. At the free end of the lever arm 36, the one end of an intermediate lever 37 is linked by means of a link pin 39 which is parallel to the axis of the shaft 12. The other end of intermediate lever 37 is via a ball joint 39' connected with one end of a threaded spindle 40, which with its other end, which has a setting or handwheel 41, protrudes from the side 42 of the machine base and meshes with a thread 43, which is in this side 42. It is understood, that the axes of the shaft 12 and the threaded spindle 40 are vis a vis each other off-set or lie in different planes in such a fashion that when the threaded spindle 40 is turned by means of the handwheel 41, the threaded spindle 40 which moves or shifts hereby in horizontal direction, executes a rotary moment via the intermediate lever 37 on the lever arm 36. This rotary moment swivels the bearing component 14 and with it the intermediate carrier 10 around a vertical axle 11, i.e. around the axis of shaft 12.

As FIG. 3 shows in particular, the drive 13 that serves as correction setting is depicted as a planetary drive. This drive consists essentially of a cylinder shaped housing 44 which has at its peripheral surface a tooth system 45 or which is shaped as a gear at its peripheral surface. The tooth system 45 can be made either as one piece with the housing 44 or it can be in the shape of toothed ring, which is attached to the peripheral surface of the housing 44 by means of screws 46.

At its lower side, or at the front plate provided for this purpose the housing 44 is rotatably mounted at the outer surface of a cylinder or sleeve shaped lower section 48 of a gear 49 as shown in FIGS. 2 and 3.

It is mounted around the axle 11, while the housing 44 is rotatably mounted to the front plate by means of a ball bearing 50 at the outer surface of a cylinder or sleeve shaped section 51 of a gear 52. The sleeve shaped section 51 surrounds another sleeve shaped upper section 53 of the gear 49, whereby there are two needle bearings 54 between the sections 51 and 53, so that the gears 49 and 52 can be rotated relative to each other as well as to the housing 44.

In the housing 44, which serves as planetary gear carrier there are attached two gears 56 and 57, of which gear 56 contacts or meshes with the gear 52 and gear 57 with gear 49. The shaft 55 is, at its lower as well as its upper end, mounted via needle bearings 58 so that it can rotate, and this around an axle which is parallel to the rotary axle of the gears 49 and 52, however off-set laterally in relation to this rotary axle.

The lower end of the shaft 12 which protrudes beyond the bearing component 14 reached into the sleeve shaped section 48 and 53 of the gear 49 and is torsionally solidly connected with this gear. The tooth system 45 meshes with a not more closely detailed gear or gear ring, which is directly connected as to drive with the drive for the rotary table, when necessary via additional drive means or gears which are not detailed more closely. The housing 44 forms also the drive part of the drive system 13, while the gear 49 is the driven part of this drive system.

A lever arm 59 is torsionally solidly mounted on the outer surface of the section 51 which protrudes above the housing 44. For this purpose the lever arm 59 has at one end a hole or opening in which the section 51 reaches. Besides this the section 51 has at its outer surface at least one projection 60 which fits in a corresponding groove, which is in the hole of the lever arm 59.

At the other end of the lever arm 59, which is angular or hook shaped in the depicted configuration so that it partially comprises the housing 44, is linked at one end to an intermediate lever 62 by means of a vertical link pin 61. The other end of the intermediate lever 62 is via a ball joint 63 flexibly linked with one end of the rod 64. This rod is again pushed to the outside through the side 42 of the machine base.

The rod 64 is at the end which protrudes outside the side 42 partially surrounded by a sleeve 66 which is attached to this side 42 by means of screws 65. This sleeve 66 has at its outer surface a thread. This outer thread of the sleeve shaped component 66 meshes with the inner thread of a sleeve shaped component 67, to which or to the closed end of which the rod 64 is attached at the end that protrudes from the side 42.

It is understood, that also here the axes of the shaft 12 and the rod by which runs in horizontal direction are spacially off-set in relation to each other or are mounted in different planes, so that with hand rotation of the setting component 67 and with it the obtained shifting of the rod 64 a rotary moment is executed on the lever arm 59 in longitudinal direction of this rod via the intermediate lever 63. This rotary moment swivels or rotates the lever arm and with it the gear 52 around the axis of shaft 12. Through this swiveling of the lever arm 59, an angle rotation takes place between the drive part (housing 44) and the driven part (gear 49) of the drive system 13, with which angle rotation a correction setting can be made for as long as it takes that the labels 5 obtain the desired position on the bottles 7. And this can be done continuously and above all while the labeling machine or labeling station is in operation as well.

It is in essence possible to couple the lever arm 59 or its setting with the setting of the intermediate carrier 10. Since there are outside the angle setting, which is made by the gripper cylinder 6 or the carrier plate 1, both in relation to the rotary table 8, still other factors which influence the position of the labels 5 on the bottles 7, the described infinitely variable and separated setting of the lever arm 59 is especially effective.

The invention is described above on the hand of a configuration example. It is understood that changes as well as developments are possible without deviating from the principal thought of the invention.

I claim:

1. A labelling machine having a labelling station and a main drive for moving containers in succession past said labelling station so that labels may be applied to said containers, said labelling station including label transfer means rotatably mounted about a first axis, label supply means, and label gripping means rotatably mounted about a second axis, said label transfer means being constructed and arranged to remove labels sequentially from said label supply means and transfer the same to said label gripping means, drive means for rotating said label transfer means and said gripper means in synchronism with each other and the drive means for the labelling machine whereby labels received by the label gripping means will be deposited on containers moving successively past said labelling station, said drive means including a driven part coupled to said main drive and a driving part coupled to said label transfer means for rotating the label transfer means in synchronism with the main drive, the improvement comprising means for adjusting the rotational angle of said driving part relative to said driven part so that the rotational angle of said label transfer means relative to said label gripping means will be modified and the angular position of the label gripping means when it receives a label from said label transfer means relative to the position of each container is likewise adjusted so that the position at which the label is applied to the container can be controlled.

2. The labelling station set forth in claim 1 wherein said drive means comprises a planetary drive having a first carrier rotatably mounted about the first axis and comprising the driven part and a second carrier rotatably mounted about said first axis and comprising said driving part, and gear means interconnecting said first and second carriers, said second carrier being coupled to said label transfer means and said adjusting means being operative to change the rotational position of said second carrier relative to said first carrier.

3. The labelling station set forth in claim 2 wherein said gear means includes a first gear means mounted on said first carrier for rotation about a third axis parallel to said first axis, a third carrier rotatably mounted about said first axis, said gear means also including second and third gear means mounted on said second and third carrier means, respectively, and meshing with said first gear means, said adjusting means being coupled to said third gear means for rotating said third gear means about said first axis whereby the angular position of said second carrier means is modified relative to said first carrier means.

4. The labelling stations set forth in claim 3 wherein said first, second and third axes are vertical.

5. The labelling stations set forth in claims 2, 3 or 4 and including a first support pivotally mounted about said first axis, said label transfer means and said gripping means being mounted on said first support for pivotal movement toward and away from the containers so that labels can be applied to containers of different sizes.

6. The labelling station set forth in claim 5 wherein said label transfer means includes a second support rotatably mounted about said first axis on said first support and at least one labelling transfer element mounted on said second support for pivotal movement about a fourth axis, said second support being coupled to said second carrier for rotation by said drive means about said first axis.

7. The labelling station set forth in claim 6 and including a first shaft rotatably mounted about said first axis, said label transfer means being mounted on said first shaft, a second hollow shaft rotatably mounted on said first shaft, said hollow shaft comprising said second carrier means, said adjusting means being coupled to said second shaft for rotating the same about said first shaft.

8. The labelling station set forth in claim 7 wherein said adjusting means includes a lever coupled to said second shaft, and rotatable rod means coupled to said lever for moving the same about said first axis.

9. The labelling station set forth in claim 8 and including a threaded setting element coupled to the other end of said rod and means for advancing and retracting said rod means to swivel said lever.

10. The labelling station set forth in claim 9 wherein said threaded setting element comprises a treaded spindle on said rod means received in a threaded support.

11. The labelling station set forth in claim 10 and including a cartridge means and bearing means for rotatably supporting said cartridge means, said first shaft being received in said cartridge means and said label transfer means being mounted on said cartridge means.

12. The labelling station set forth in claim 11 wherein the first support includes control cam means and roller means mounted on the label transfer element whereby said label transfer element is swivelled about said fourth axis.

* * * * *